US005927438A

United States Patent [19]

Ostrobrod

[11] Patent Number: 5,927,438

[45] Date of Patent: Jul. 27, 1999

[54] PERSONNEL LIFTING-LOWERING SYSTEM

[76] Inventor: Meyer Ostrobrod, 2070 Bennett Rd., Philadelphia, Pa. 19116

[21] Appl. No.: 08/724,092

[22] Filed: Sep. 30, 1996

[51] Int. Cl.[6] ..... A62B 1/08

[52] U.S. Cl. ..... 182/241; 182/5; 182/7; 182/192; 182/235

[58] Field of Search ..... 182/3, 4, 5, 7, 182/234, 235, 241, 192, 193; 188/65.1, 65.2

[56] References Cited

U.S. PATENT DOCUMENTS

| | | | |
|---|---|---|---|
| 290,076 | 12/1883 | Lewis et al. | 182/241 X |
| 416,550 | 12/1889 | Betten | 182/7 X |
| 659,093 | 10/1900 | Ockers | 182/241 |
| 2,937,853 | 5/1960 | Jackson, Jr. | 182/241 |
| 3,179,994 | 4/1965 | Meyer et al. | 24/134 |
| 3,519,248 | 7/1970 | Kushiro | 182/241 X |
| 4,077,094 | 3/1978 | Swager | 182/5 X |
| 4,253,218 | 3/1981 | Gibbs | 182/5 X |
| 4,598,793 | 7/1986 | Lew et al. | 182/5 X |
| 4,702,348 | 10/1987 | Lew et al. | 182/5 X |
| 5,156,240 | 10/1992 | Ostrobrod | 188/65.1 |
| 5,305,852 | 4/1994 | Klokseth | 182/241 |

FOREIGN PATENT DOCUMENTS

| | | | |
|---|---|---|---|
| 848874 | 11/1939 | France | 182/241 |
| 2407770 | 8/1975 | Germany | 182/241 |

OTHER PUBLICATIONS

International Safety Equipment System "99" Advertisement

Grip Safety & Rescue Systems GripTech Advertisement.

*Primary Examiner*—Daniel P. Stodola
*Assistant Examiner*—Richard M. Smith
*Attorney, Agent, or Firm*—Norman E. Lehrer

[57] ABSTRACT

A pulley system particularly useful for lifting or lowering an injured worker includes an upper pulley assembly adapted to be secured to a fixed structure and a lower pulley assembly adapted to be secured to the worker being lifted or lowered and further includes a rope having one end secured to one of the pulley assemblies. The rope is arranged in a substantially conventional manner around the pulleys whereby when a force is exerted on the free end of the rope, the worker can be raised and when a force is removed from the free end of the rope, the worker can be lowered. A pulley wheel forming part of one of the pulley assemblies has outwardly flared internal side walls. The lifting rope passes around the pulley wheel for only approximately 180°. The dimensions of the rope and the pulley wheel are such that the rope engages the side walls of the pulley wheel. The pulley wheel is freely rotatable in a direction that allows the worker to be lifted but is incapable of rotating in the opposite direction when the load is being lowered. As a result, the rope frictionally engages the side walls of the pulley wheel to retard the movement of the rope. A brake prevents movement of the rope in a direction that would allow for descent. The brake is movable between an inoperative position wherein the rope can freely pass therethrough and an operative position wherein the rope can pass through in the ascending direction but not move in the descending direction. The brake is normally biased into the operative position but may be remotely operated to move the same into its inoperative position.

4 Claims, 3 Drawing Sheets

PERSONNEL LIFTING-LOWERING SYSTEM

BACKGROUND OF THE INVENTION

The present invention is directed toward a personnel lifting or lowering system and, more particularly, toward such a system which utilizes a plurality of pulleys. The system can be used by a worker for lifting or lowering himself or herself to or from an overhead position or could be used by other workers to lift or lower an injured worker or substantially any other load.

In a wide variety of construction and/or repair projects and in many other situations, it is often necessary to lift or lower a substantial load through a vertical distance. Not infrequently, a worker may become injured while working underground and must be lifted to ground level. Similarly, a worker who may become injured while working at an elevated position may have to be lowered to safety. The present invention is particularly suited for rescuing an injured worker by lifting or lowering him or her.

One of the more common ways of lifting or lowering an injured worker is through the use of a winch or the like. While winches may be effective in certain situations, there are other times when they are of little use. A winch must be mounted at a fixed position and there must be a worker at that fixed position to operate the winch. Thus, if a worker is injured at a lower position and the winch is located at an elevated position, any worker assisting the injured person must first climb up to the elevated position in order to operate the winch. Furthermore, there are times when a workman may wish to raise or lower himself and may be physically capable of doing so but cannot do so with a fixed winch-type system.

Pulley systems have also been utilized over the years to lift or lower injured workers or other loads. Such conventional pulley systems, however, can be rather dangerous and can result in even more serious injuries. Conventional pulley systems have no braking systems or the like to prevent a free fall in the event that a worker accidentally releases the end of the rope. Furthermore, although the pulley system may offer some mechanical advantage, the amount of effort involved in operating the same can still be great.

Systems have been proposed which are intended to improve on conventional pulley systems that have previously been available. International Safety Equipment Inc., of Devault, Pa. for example, offers a personnel lifting and lowering system under the name System "99". The System "99" is arranged and functions in a manner similar to a conventional pulley system but includes a capstan/roller drum at the upper portion thereof. The roller drum can rotate in only the lifting direction and is provided with means for preventing rotation in the lowering rotation. The lifting rope is wrapped two and a half times around the stationary drum to thereby provide a friction braking action when a load is being lowered.

While the ISE System "99" may provide some benefits over conventional pulley systems, it may still not be fully satisfactory. Among other things, the use of a capstan/roller drum may add unnecessary weight to the system. Furthermore, the System "99" does not include a braking means or the like for preventing free fall.

Also available on the market is the GRIP-TECH rescue system by Grip Safety & Rescue Systems Corp., of West Seneca, N.Y. The GRIP-TECH system is similar to a conventional pulley-type system but includes a brake or automatic fall arrester which locks the rope when a predetermined descent speed is sensed. While this may provide some additional safety, it does not provide the advantages of a constantly applied reverse brake which would allow a worker to let go of the lifting rope at any time without allowing for any significant movement of the worker being raised.

SUMMARY OF THE INVENTION

The present invention is designed to overcome the deficiencies of the prior art described above. The pulley system of the present invention is particularly useful for lifting or lowering an injured worker and includes an upper pulley means which is adapted to be secured to a fixed structure and a lower pulley means which is adapted to be secured to the worker intended to be lifted or lowered and further includes a rope means having one end secured to one of the pulley means. The rope means is arranged in a substantially conventional manner around the pulleys whereby when a force is exerted on the free end of the rope means, the worker or other load can be raised and when a force is removed from the free end of the rope, the worker or other load can be lowered.

A pulley wheel used as part of at least one of the pulley means has outwardly flared internal side walls and has the lifting rope passing around the pulley wheel for only approximately 180° . The dimensions of the rope and the pulley wheel are such that the rope engages the side walls of the pulley wheel. The pulley wheel is also mounted so as to be freely rotatable in a direction that allows the worker to be lifted but is incapable of rotating in the opposite direction when the load is being lowered whereby the rope frictionally engages the side walls of the pulley wheel to retard the movement of the rope.

A brake means i s also included for preventing movement of the rope in a direction that would allow for descent. The brake means is movable between an inoperative position wherein the rope can freely pass therethrough and an operative position wherein the rope can pass through in the ascending direction but cannot move in the descending direction. The brake means is normally biased into the operative position but may be remotely operated to move the same into its inoperative position whenever desired.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
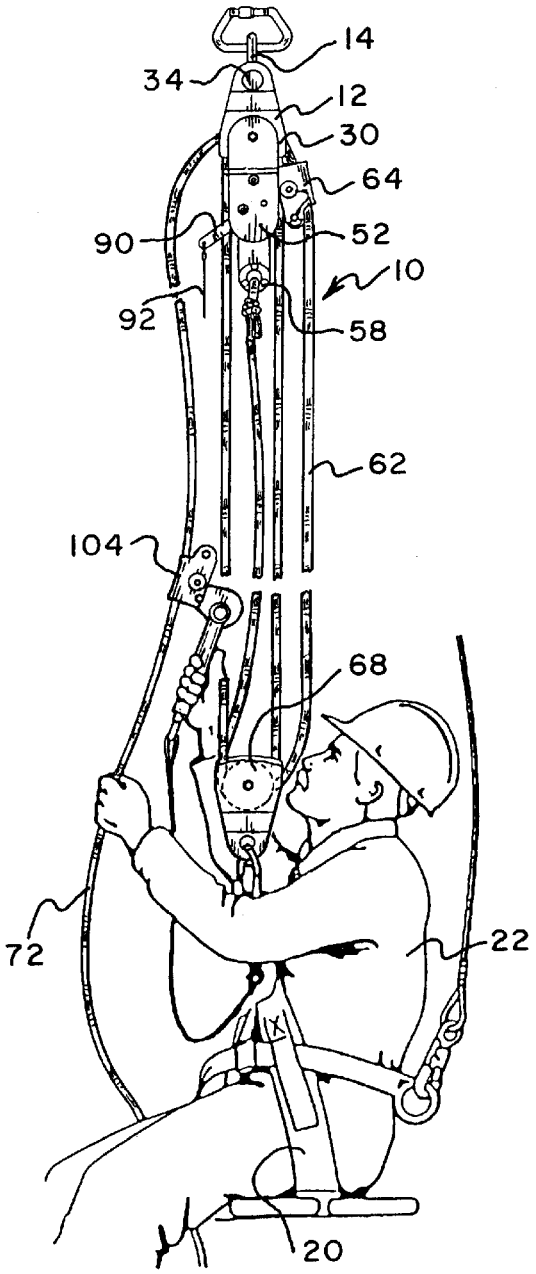
FIG. 1 is an elevational view shown partially diagrammatically of the personnel lifting and lowering system of the present invention in use.

Referring now to the drawings in detail wherein like reference numerals have been used throughout the various figures to designate like elements, there is shown in FIG. 1 a personnel lifting and lowering system constructed in accordance with the principles of the present invention and designated generally as 10. The system 10 is comprised generally of an upper pulley means 12 which, through upper eye bolt 14, is adapted to be connected to a fixed structure which may be, for example, at an elevated position such as on a bridge or upper floor of a building or may be secured at ground level above a manhole opening or the like.

The personnel lifting and lowering system 10 also includes a lower pulley means 16 which, through the use of the eye 18 at the lowermost end thereof, is adapted to be connected to a harness or seat 20 or the like which, in turn, supports a worker 22 there on. It should be understood, however, that this is by way of example only as the pulley system of the present invention could be used to lift or lower inanimate loads such as construction materials or equipment or the like.

The upper pulley means 12 is comprised essentially of a housing consisting of four depending spaced apart vertical walls 24, 26, 28 and 30. The upper ends of the vertical walls 24–30 are secured together through the use of a cross bolt 32 connected to the upper eye bolt 14. Knobs 34 and 36 can be unscrewed to release the outermost walls 24 and 30, respectively, from the cross bolt 32. When the knobs 34 or 36 are removed, the respective side wall 24 or 30 is free to rotate about the axle 38 in order to expose the interior of the space between the side walls 24 and 26 or the space between the side walls 28 and 30.

Figure 4:
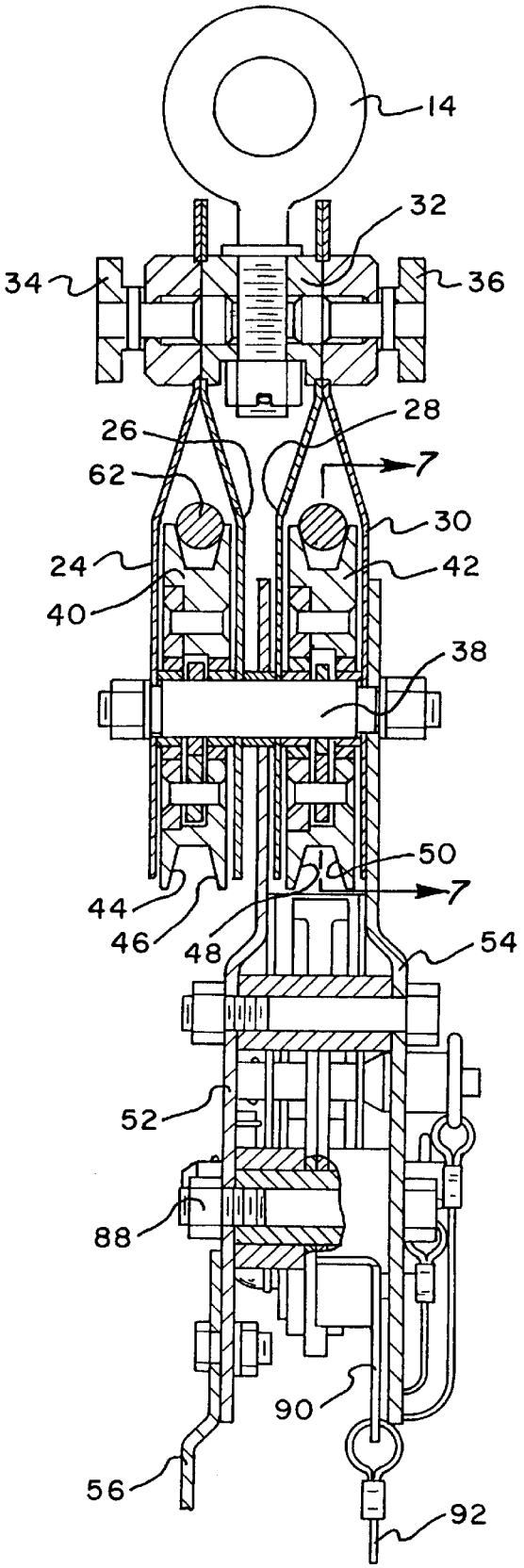
FIG. 4 is a cross-sectional view taken through the lines 4—4 of FIG. 3.

A first pulley wheel 40 is mounted on axle 38 between the side walls 24 and 26. Similarly, a second pulley wheel 42 is mounted on axle 38 between the side walls 28 and 30. Pulley wheels 40 and 42 have a generally known configuration with tapered internal side walls 44 and 46 and 48 and 50, respectively, as best shown in FIG. 4. In the manner described in more detail hereinafter, however, the pulley wheels 40 and 42 are capable of freely rotating in one direction only about the axle 38. The pulley wheels are incapable of rotating in the reverse direction.

Also pivotally connected to the axle 38 are downwardly extending spaced apart plates 52 and 54 which preferably are mounted on either side of the walls 28 and 30 as seen most clearly in FIG. 4. Extending downwardly from the plate 52 essentially centrally of the upper pulley means 12 is a support bracket 56 having an eye 58 formed therein to which is tied one end 60 of rope 62. The spaced apart plates 52 and 54 are also used to support a brake mechanism 64, the details of which will be described further hereinafter.

Figure 2:
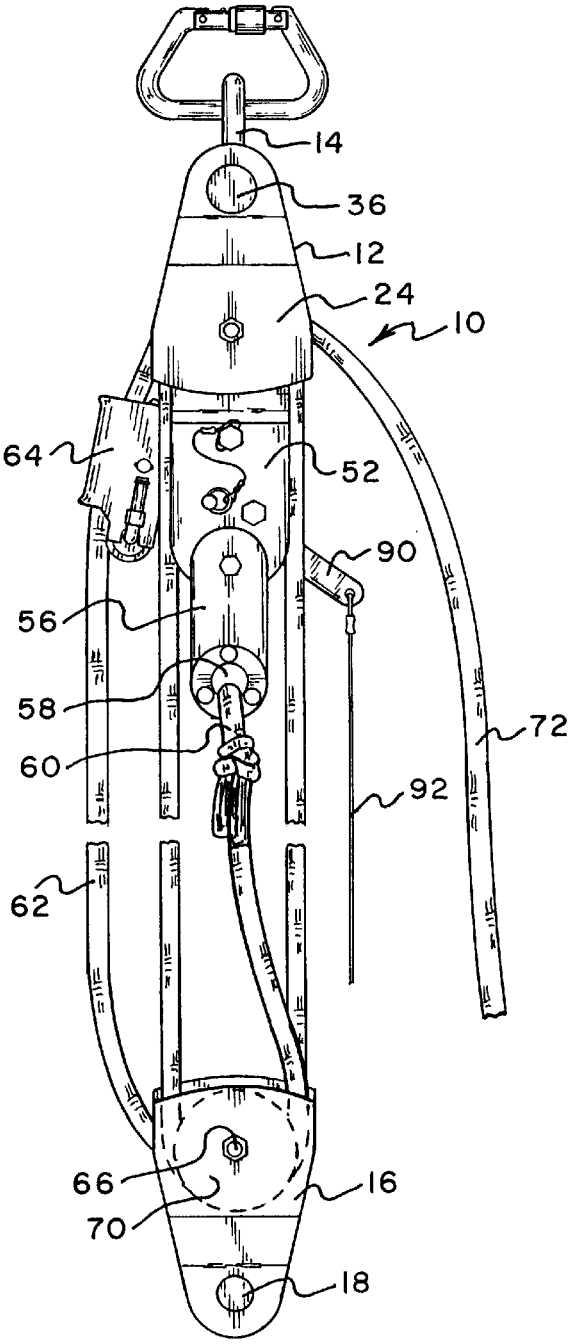
FIG. 2 is a view similar to FIG. 1 showing only the personnel lifting and lowering system from the back side of FIG. 1.
Figure 3:
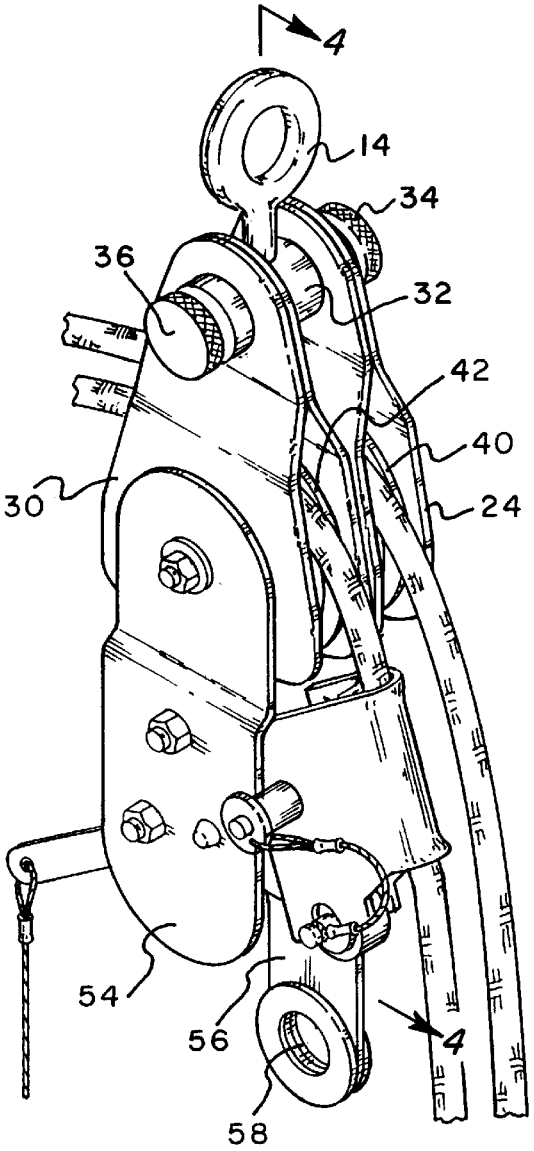
FIG. 3 is a top perspective view showing the details of the upper pulley means of the system shown in FIGS. 1 and 2.

The lower pulley means 16 includes a pair of side-by-side pulley wheels coaxially mounted for free rotation about axle 66. The first lower pulley wheel 68 is shown in phantom in FIG. 1 while the pulley wheel 70, located directly behind the pulley wheel 68, is shown in phantom in FIG. 2.

The rope 62 after being tied to the eyelet 58 passes downwardly around lower pulley wheel 70 then upwardly around the first upper pulley wheel 40. From there, the rope continues downwardly around the second lower pulley wheel 68 and again upwardly where it passes through brake mechanism 64 and around the second upper pulley wheel 42. The free end 72 of the rope 62 then extends downwardly again as shown most clearly in FIGS. 1 and 2. With the exception of the nonreversing features of the upper pulley wheels 40 and 42 and the brake mechanism 64, the pulley system thus described with the upper and lower pulley means 12 and 16 and the manner in which the rope 62 is arranged thereon will function in a conventional manner well known in the art. That is, when a downward force is applied to the end 72 of rope 62, the lower pulley means 16 and the worker 22 or other load attached thereto will be raised with a mechanical advantage of 4 to 1. Similarly, if a force is removed from the end 72 of the rope 62, i.e. if the rope is let out, the worker 22 or other load will be lowered or will be allowed to descend.

As mentioned above, the upper pulley wheels 40 and 42 are mounted on the axle 38 so as to be rotatable in one direction only. The manner in which this is accomplished is shown most clearly in FIG. 7 which illustrates the mounting of the pulley wheel 42 on the axle 38. While only pulley wheel 42 is being described in detail, it will be understood that pulley wheel 40 is constructed and mounted in substantially the same manner.

Figure 7:
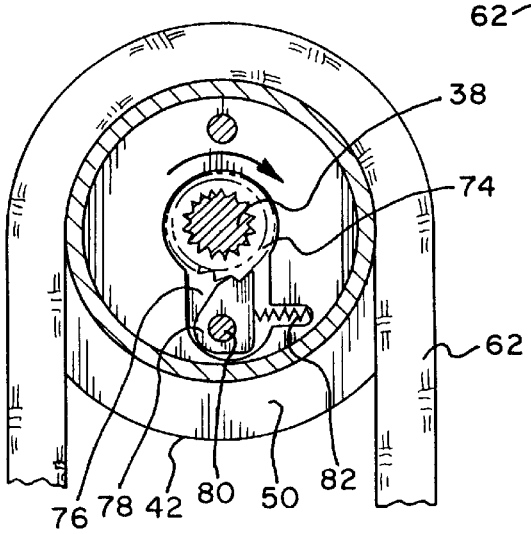
FIG. 7 is a cross-sectional view taken through the lines 7—7 of FIG. 4.

Referring to FIGS. 4 and 7, it should first be noted that the axle 38 is fixed within the upper pulley means 12. That is, it does not freely rotate with respect to the remaining component parts thereof and particularly the vertical walls 26 and 28. Surrounding the axle 38 in a position essentially concentric with the pulley wheel 42 is a ratchet wheel 74. Ratchet wheel 74 is fixed to the axle 38 so as not to rotate therewith.

The side surface of the pulley wheel 42 is provided with a recess 76. A pawl 78 is located within the recess 76 and is mounted for rotation about a pivot point 80. A spring 82 biases the pawl 78 into the position shown in FIG. 7 wherein the teeth at the end of the pawl engage the teeth of the ratchet wheel 74 to prevent rotation of the pulley wheel 42 in the counterclockwise direction as shown in FIG. 7. As will be seen, this is also the lowering or ascending direction of the rope 62. However, when the pulley wheel 42 is rotated clockwise as shown in FIG. 7, the front end of the pawl 78 is cammed outwardly in the radial direction away from the axis 38 by the teeth of the ratchet gear 74 and the teeth freely pass thereunder so that the pulley wheel 42 can freely rotate in the clockwise direction as shown in FIG. 7. This is also the lifting or ascending direction caused by an external force being applied to the free end 72 of the rope 62.

The pulley system 10 thus far described is used in the conventional following manner. When it is desired to lift a worker 22 or other load, all that is necessary is for a fellow worker to pull downwardly on the free end 72 of rope 62. Upper pulley wheels 40 and 42 and lower pulley wheels 66 and 68 will rotate freely thereby lifting the worker 22. When it is desired to lower a worker 22 or other load, the co-worker allows the free end 72 of the rope 62 to move upwardly by reducing the force thereon in the known manner. The upper pulley wheels 40 and 42, however, lock in place and will not rotate in the reverse or descending direction. As a result, the rope 62 frictionally engages the upper pulley wheels 40 and 42 and while the rope is permitted to slide around the pulley wheels, the friction causes a drag on the rope which assists the co-worker in lowering the worker 22 by reducing the forces which must be applied.

As shown in FIG. 7, the rope 62 passes only approximately 180 ° around each of the upper pulley wheels 40 and 42. However, and as shown in FIG. 4, the diameter of the rope 62 is such that it engages the side walls 44, 46, 48 and 50 of the pulley wheels 40 and 42. The rope 62 is, therefore, wedged into the pulley wheels thereby increasing the friction and drag on the rope in the descending direction. As should be readily apparent, because of the outwardly flared shape of the walls 44–50 and the diameter of the rope 62, the more force that may be applied by the worker 22 or other load, the more the rope 62 wedges itself into the pulley wheel to again further increase the friction or drag.

As pointed out above, the pulley system 10 of the present invention also includes a brake mechanism 64 through which the rope 62 passes. The brake mechanism 64 is pivotally mounted on a rotating plate 84 through pivot 86. Plate 84 is, in turn, pivotally secured to the spaced apart plates 52 and 54 through the pivot or axle 88. This arrangement allows the brake mechanism 64 to be moved between an upper or inoperative position as shown in FIG. 5 and a lower, operative position as shown in FIG. 6.

Figure 6:
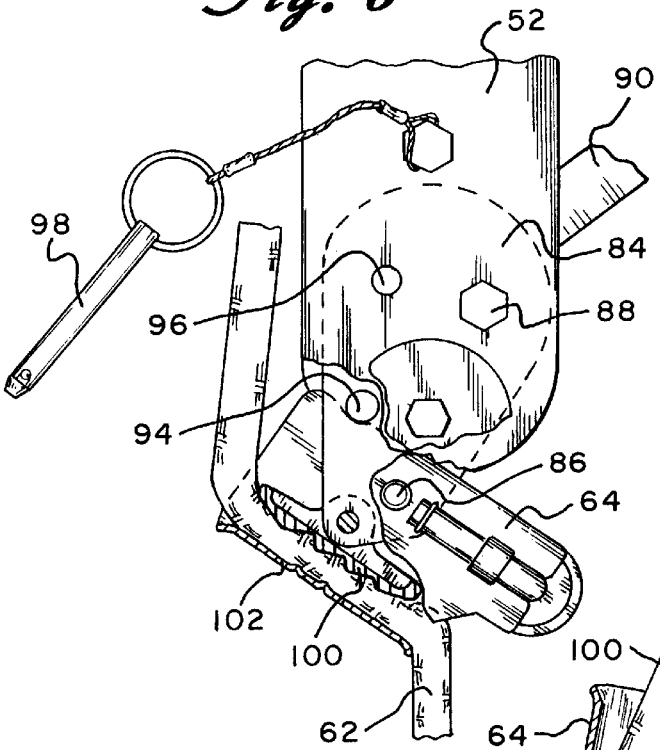
FIG. 6 i s a view similar to FIG. 5 showing the brake mechanism in its operative position.

As a result of gravity and the normal movement of the rope 62, the brake mechanism 64 is normally biased downwardly into the inoperative position shown in FIG. 6. It can, however, be raised into the operative position through the use of lever 90 which secured to the plate 84 and which extends outwardly therefrom. An elongated cord 92 attached to the end of the lever 90 allows the lever to be operated from a remote position. The brake mechanism 64 can, however, be maintained in its upper, inoperative position, by aligning the apertures 94 and 96 in the plates 84 and 52, respectively, and inserting pin 98 therein, obviously, when pin 98 is removed, the plate 84 is free to rotate relative to the plate 52.

Figure 5:
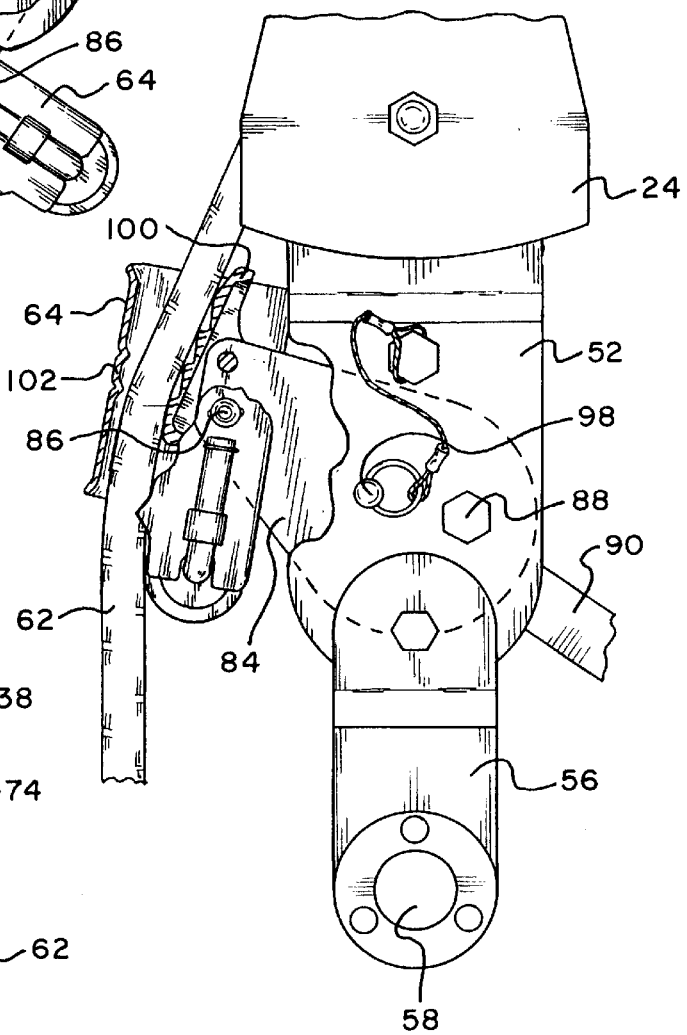
FIG. 5 is a view of a portion of the upper pulley means of FIG. 2 with parts broken away for clarity and showing the brake mechanism in its inoperative position.

As shown most clearly in FIG. 5, when the brake 64 is in its upper or inoperative position, the brake shoe or dog 100 moves away from the front wall 102 of the brake mechanism thereby allowing space for the rope 62 to freely pass therethrough in any direction. When the brake mechanism 64 is, however, pivoted downwardly into its lower and operative position as shown in FIG. 6, the brake shoe 100 moves toward the front wall 102 of the brake mechanism 64 engaging the rope 62. Because of the configuration of the surface of the brake shoe 100, the rope 62 can be moved more easily upwardly through the brake 64 than downwardly. When being moved downwardly, the rope engages the brake shoe and cams the same into an even tighter brake.

The brake mechanism 64 is, per se, well known in the art and is described in U.S. Pat. No. 5,156,240, the subject matter of which is incorporated herein by reference. More specifically, the brake mechanism 64 is constructed in a manner similar to that shown in FIGS. 6 and 7 of the prior patent. Accordingly, it is not believed that the details of the construction of the brake mechanism 64 need be specifically included herein.

In operation and with the brake mechanism 64 locked into its upper position as shown in FIG. 5, the pulley system of the present invention is used in the manner described above. That is, when a downward force is exerted on the end 72 of the rope 62, the worker 22 or other load is lifted. On the other hand, when force is removed from the end 72 of rope 62, i.e. when the rope is let out, the worker 22 is lowered and the one-way pulley wheels in the upper pulley means 12 reduce the force needed to lower the worker.

In order to utilize the brake mechanism 64, the pin 98 is removed from the apertures 94 and 96 and the brake mechanism 64 pivots downwardly into the position shown in FIG. 6. This is due to both gravity and the rope 62 being pulled downwardly by the weight of the worker 22. As the free end 72 of the rope 62 is pulled, however, the rope moves upwardly pulling the brake mechanism 64 upwardly therewith until the brake shoe 100 opens thereby allowing the rope 62 to be drawn freely through the brake mechanism 64 so that the worker 22 can be lifted. If, however, the pulling force is removed from the end 72 of the rope 62, the brake mechanism immediately is pulled downwardly into the locking position and the rope stops essentially immediately thereby preventing free fall of the worker.

Obviously, the free end of the rope 72 can be pulled by a co-worker in order to lift the worker or, as shown in FIG. 1, the worker 22 may himself pull on the free end 72 of the rope. Preferably, he can do this utilizing a rope grab mechanism 104 which can easily and freely slide upwardly through the rope 62 but which locks onto and grabs the rope in the downward direction. The rope grab mechanism 104 is described in detail in prior U.S. Pat. No. 5,156,240.

With the brake mechanism 64 in its operative position as shown in FIG. 6, free fall of the worker 22 is obviously prevented. However, if it is desired to lower the worker when the brake mechanism is in its operative position, this can be done by pulling downwardly on the cable 92 to pull the lever 90 downwardly which, in turn, will move the brake mechanism 64 into its upper or inoperative position. In order to control the descent of the worker, controlled downward force on the cable 92 is necessary. That is, either the worker 22 himself or a co-worker will pull slowly on the cable 92 allowing the rope to slide through the brake and will release downward pressure on the cable 92 thereby again engaging the brake if the worker begins to descend too quickly.

The present invention may be embodied in other specific forms without departing from the spirit or essential attributes thereof and accordingly reference should be made to the appended claims rather than to the foregoing specification as indicating the scope of the invention.

I claim:

1. In a pulley system for lifting or lowering a load comprising an upper pulley assembly adapted to be secured to a fixed structure and a lower pulley assembly adapted to be secured to the load intended to be lifted or lowered and a rope having one end secured to one of said pulley assemblies and a free end; said rope being arranged around said one of said pulley assemblies whereby when a force is exerted on the free end of said rope, said load can be raised and when a force is removed from said free end of said rope, said load can be lowered, wherein the improvement comprises:

at least one of said pulley assemblies including a pulley wheel having outwardly flared internal side walls, said rope passing around said pulley wheel for only approximately 180 ° and engaging each of said side walls, means mounting said pulley wheel so that said pulley wheel may freely rotate in one direction but is incapable of rotating in the opposite direction and said rope being arranged such that when a force is applied to the free end of said rope said pulley wheel freely rotates but when a force is released from the free end of said rope said pulley wheel is prevented from rotating in the reverse direction and said rope frictionally engages said side walls to retard the movement of said rope, said upper pulley assembly including a housing;

braking means fixedly connected to said upper pulley assembly housing and being adapted to engage said rope, said braking means being movable between an inoperative position wherein said rope is free to move in either a lifting or lowering direction and an operative position wherein said rope is free to move in the lifting direction but which prevents substantially all movement of said rope in said lowering direction;

means for biasing said braking means into said operative position; and means at a remote location for remotely moving said braking means from said operative position to said inoperative position against the force of said biasing means.

2. The pulley system as claimed in claim 1 further including means for locking said braking means into said inoperative position.

3. The pulley system as claimed in claim 1 wherein said one of said pulley assemblies includes at least two of said pulley wheels, each of said pulley wheels having flared internal side walls engagable by said rope and each of said pulley wheels being freely rotatable in only one direction.

4. The pulley system as claimed in claim 1 wherein said mounting means includes a ratchet assembly associated with said pulley wheel, said ratchet assembly including a ratchet wheel and a spring-biased pawl, said ratchet assembly allowing said pulley wheel to freely move in said one direction and preventing movement of said pulley wheel in said other direction.

* * * * *